United States Patent [19]

Wilber

[11] Patent Number: 4,742,790

[45] Date of Patent: May 10, 1988

[54] DART STRETCHER FOR POCKET WELTING MACHINE

[75] Inventor: Richard Wilber, Yarmouth, Me.

[73] Assignee: The Reece Corporation, Waltham, Mass.

[21] Appl. No.: 100,897

[22] Filed: Sep. 25, 1987

[51] Int. Cl.[4] ..... D05B 21/00; D05B 3/00

[52] U.S. Cl. ..... 112/262.3; 112/121.26; 112/305; 112/121.15

[58] Field of Search ..... 112/121.26, 121.27, 112/70, 68, 76, 114, 305, 311, 262.3, 262.1, 121.12, 121.15

[56] References Cited

U.S. PATENT DOCUMENTS

| | | | |
|---|---|---|---|
| 3,550,544 | 12/1970 | Perla | 112/121.26 |
| 3,930,453 | 1/1976 | Hintzen et al. | 112/68 |
| 4,258,637 | 3/1981 | Hannemann | 112/121.26 |
| 4,274,345 | 6/1981 | Schneider et al. | 112/311 X |
| 4,341,169 | 7/1982 | Mainet et al. | 112/121.12 |
| 4,512,269 | 4/1985 | Bewditch | 112/311 X |
| 4,594,956 | 6/1986 | Vartoukian et al. | 112/121.26 X |

*Primary Examiner*—H. Hampton Hunter

*Attorney, Agent, or Firm*—McAulay, Fields, Fisher, Goldstein & Nissen

[57] ABSTRACT

An automatic dart stretcher for removal of the fullness of material from a portion of a garment around a dart seam to faciliate the sewing of a pocket welting onto the garment proximate thereto; two pairs clamping feet are provided to hold the material in an orthogonal and a parallel direction relative to the seam; the two pairs of clamping feet being orthogonally movable relative to each other, one clamping foot of each pair of clamping being movable together in a first direction and one clamping foot of each pair of feet being movable in a second direction orthogonal to the first direction.

17 Claims, 6 Drawing Sheets

DART STRETCHER FOR POCKET WELTING MACHINE

BACKGROUND OF THE INVENTION

This invention is concerned with a dart stretcher.

More particularly, the invention is concerned with the removal of fullness at the end of a dart when sewing of a pocket welting onto a garment having a dart and is to be used in conjunction with pocket welting machines.

DESCRIPTION OF THE PRIOR ART

So far as applicant is aware, there is no presently available automatic dart stretcher to remove the fullness of a material located at the end of a dart, and the particular function heretofore was usually and conventionally carried out by an operator by hand.

As is well known, in the manufacture of clothing, such as trousers, coats, dresses, etc., in addition to the loss of a great deal of production time by the operator, inaccurate sewing of the pocket welting to the dart may result in a poorly made garment.

More specifically, when an operator of a pocket welting machine must manually remove the fullness of material located at the end of a dart, this is a slow, tedious and time-consuming operation. In the usual situation, the operator must stretch or tug at the garment before actually commencing the sewing to remove the fullness. If the fullness is not removed, the garment area near the fullness will bunch up during the sewing process and will cause or result in a fold to be sewn into the garment or an unsewn portion. Of course, such garments must then be set aside to be manually repaired or scrapped altogether.

It is believed that there is no commercially available device which will remove the fullness at the end of a dart without some additional hand-handling or manual operation by the operator or increased cycle time.

Machines for holding material so that further operations can be performed are known, and an example is U.S. Pat. No. 4,341,169 to Mainot et al., which is concerned with the manufacture of a welted opening in a piece of material. In machines of this type, different pieces of material are held together so that the pocket opening can be made and then the several pieces of material are moved to another manufacturing station. However, the aforesaid patent does not contemplate the sewing of a pocket welting to a dart.

There are also machines provided with vertically movable left and right clamping feet, but these are not intended for use in stretching operations in directions orthogonal to each other.

SUMMARY OF THE INVENTION

The automatic dart stretcher is intended for use in connection with pocket welting machines.

It is an object of the invention to provide automatic machinery for use in connection with the removal of the fullness of material located at the end of a dart.

A further purpose of the invention is the provision of an automatic dart stretcher for use in connection with pocket welting machines.

A feature of the invention is the provision of a dart stretching apparatus having a pair of upper and a pair of lower clamping feet so that the upper and lower feet can move laterally and longitudinally relative to each other to provide for stretching in both lateral and longitudinal directions. The upper and lower feet move both individually and as a unit. Specifically, the upper feet and lower feet move longitudinally relative to each other, and the upper left and lower left feet move transversely as a unit with respect to the upper right and lower right feet and vice-versa.

For the sake of simplicity, the preferred form of the invention contemplates that the lower feet be movable in both longitudinal and transverse directions, while the upper feet are only movable in the transverse direction.

The automatic dart stretcher, according to the invention, operates during the normal loading cycle. The garment is loaded onto the base plate of a pocket welting machine, and the automatic dart stretcher uses partial pressure to clamp different areas of the material encompassing the dart and stretching takes place in orthogonal directions relative to the dart.

To these ends, the invention consists in the provision of an automatic dart stretcher comprising a pair of spaced connecting arms; a first pair of clamping feet, one of the clamping feet being operatively associated with each of the connecting arms; a second pair of clamping feet operatively associated with the first pair of spaced connecting arms and the first pair of clamping feet; and each of the first and second pair of clamping feet are coupled for movement together in a first direction towards and away from each other and the first and second pair of clamping feet are associated with each other so that each pair moves as a unit in a second direction orthogonal to the first direction.

The invention is also concerned with a method for automatically eliminating fullness in a garment material located at the end of a dart, which comprises feeding the garment material to a pocket or pocket welting sewing machine in which a dart stretcher according to the invention is associated with a sewing machine for sewing a pocket, gripping the material at four spaced points about the edges of the dart formed by a previous cut into the material and then sewn to reduce the fullness of the material to form the dart and moving the gripped material by means of the clamping feet in orthogonally related directions by the four spaced gripping points or areas under the gripping feet to remove the fullness in the material about the dart.

The pocket or pocket welting is then sewn in a substantially orthogonal direction to the material at an end of the dart remote from the top edge of the garment, such as trousers.

The method includes gripping the material at four orthogonal points or areas quadrilaterally arranged about the dart, imparting a separation movement in a first direction between one set of two gripping points or areas and a second set of the remaining two gripping points or areas, and then imparting another separation movement in an orthogonal direction to the first direction between another grouping of the four points or areas to effect a stretch of the material in a first direction and then in a second direction normal to the first direction. Gripping all four points or areas can take place simultaneously so that stretching, in effect, takes place by stretching the material from a center point defined by the intersection of lines orthogonal to lines forming each two adjacent clamping points or areas.

It is also contemplated that both directions of stretching take place simultaneously with the feet moving in both longitudinal and transverse directions after the feet are brought into contact with the material.

BRIEF DESCRIPTION OF THE DRAWING

In order that the invention will be clearly understood and readily carried into effect, reference will now be had to the accompanying drawings in which:

FIG. 4*a* is a partial front view looking in the direction along line 4—4 of FIG. 1, and showing the first position with all the feet in a raised position above the material. The material is shown raised above the table level in a somewhat exaggerated condition to emphasize that the material is not flat on the table.

FIG. 4*b* also is useful to indicate either the initial engagement of the feet of the dart stretcher with the material or an intermediate position of stretching of the material after engagement with the material but before final stretching; FIG. 4*b* is also a partial front view looking in the direction of line 4—4 of FIG. 1.

FIG. 6*a* shows the feet in their initial or rest position just prior to engagement with the material; FIG. 6*b* shows the feet after being engaged with the material or at the instant of engagement between the feet and the material and the commencement of stretching; and FIG. 6*c* shows the feet of the dart stretcher moved to its final position to stretch the material in both the longitudinal and lateral directions, the lower feet of the dart stretcher being moved from the upper feet longitudinally to stretch the material in its longitudinal direction and the left pair of feet being moved from the right pair of feet to stretch the material in both the lateral or transverse direction;

FIG. 7*a* shows the rear feet in their actual initial condition with the material thereunder in the unstretched condition shown somewhat exaggerated, and FIG. 7*b* shows the feet in their lateral separated condition to stretch the material thereunder in contact with the feet. The seam was omitted to show that the material around the seam is stretched.

FIG. 9*a* shows the lower feet in their initial condition prior to activation in the same position as in FIG. 4*a*, and FIG. 9*b* shows the lower feet in their final expanded condition, as in FIG. 4*c*.

DESCRIPTION OF THE PREFERRED EMBODIMENTS

Figure 1:
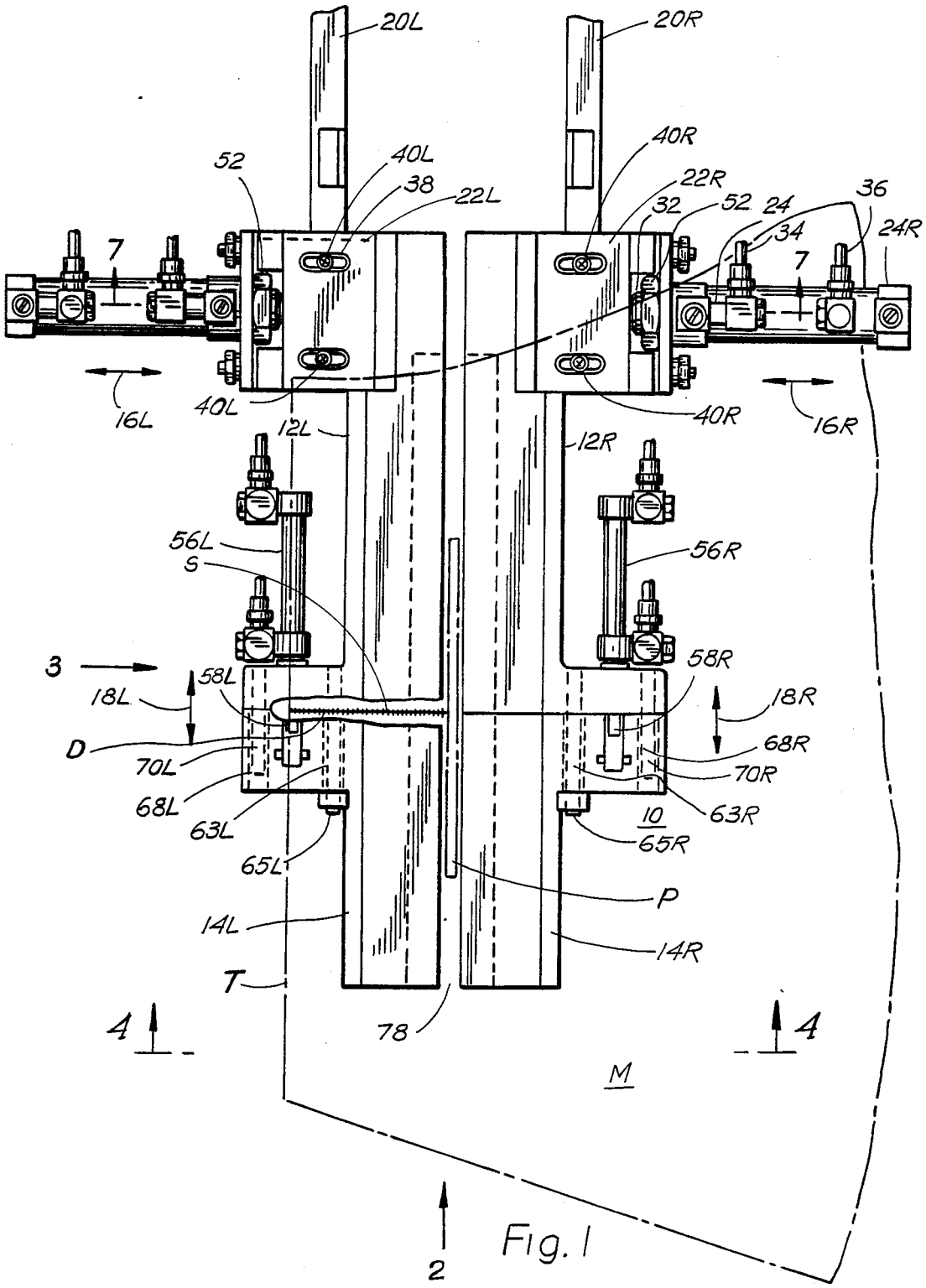
FIG. 1 is a plan view of an automatic dart stretcher in accordance with the invention placed onto a material, shown in phantom, and showing a dart seam already sewn therein, the automatic dart stretcher being shown in its initial condition just as it contacts the material; the left side portion of the clamping feet are broken away to show the dart seam and the area to which the pocket welting is to be sewn and in a relative position with respect to the seam after the material has had part of its fullness removed but prior to the sewing of the pocket welting.

Referring to the drawings, and in particular to FIG. 1, dart stretcher 10 according to the invention is positioned onto a piece of material M schematically shown having an area at which a pocket P is to be formed shown in broken outline proximate to and adjacent with a previously sewn seam S forming a dart. The top of the material edge of the garment is designated T and generally is useful to indicate for purposes of explanation that the dart starts at the top to narrow the article of clothing above the position for the pocket P. That is, as one moves down from the top T, to move towards the pocket, the material extent widens. In order for the material M at the pocket P proximate to the seam S in the unsewn condition of the pocket to have any fullness of material around the dart seam S in the material M removed, dart stretcher 10 in accordance with the teachings of this invention is used.

Suffixes L and R are used specifically to indicate the same member used with the left clamping and right clamping foot, respectively. The same reference numerals and letters are used throughout all of the Figures.

Dart stretcher 10, as indicated heretofore, is shown in FIG. 1 with some portions removed or omitted merely for purposes of explanation. When dart stretcher 10 is initially applied to material M in the preferred embodiment, seam S for the dart is not visible.

Dart stretcher 10 includes a pair of upper right and left clamping feet 12R and 12L and a pair of lower right and left clamping feet 14R and 14L relatively movable towards and away from each other as shown by double-headed arrows 16 parallel to dart seam S on material M. Upper and lower feet 12 and 14 move as a unit in the direction of double-headed arrows 16R and 16L towards and away from each other, and right and left lower feet 14R and 14L also move as a unit in a direction towards and in a direction in opposition to right and left upper feet 12R and 14L in the direction of double-headed arrows 18R and 18L which are orthogonal to arrows 16 and seam S. Double headed arrows are shown to indicate that each upper clamping foot 12R and 12L is movable separately or together to the right or to the left. Lower clamping feet 14R and 14L are movable towards and away from upper clamping feet 12R and 12L. When the dart stretcher is initially applied to material M, lower clamping feet 14L and 14R are juxtaposed or next to upper clamping feet 12L and 12R, respectively, and cover up dart seam S. The upper clamping foot 12 and the lower clamping foot 14R have been partially cut away to show seam S. The left and right clamping feet are spaced from each other, somewhat as shown in FIG. 1, and as shown in some of the other Figures to provide space for the pocket P. In any event, the left and right clamping feet are spaced from each other so that they are on opposite sides of the pocket P.

Dart stretcher 10 includes right and left connecting arms 20R and 20L for carrying and supporting right and left upper and lower feet 12R, 12L and 14R, 14L as noted for movement towards and away from each other in accordance with the direction shown by vertically oriented arrows 16 and horizonally oriented arrows 18. Each connecting arm 20R, 20L includes a support member 22R, 22L which is fixed to right and left connecting arms 20R, 20L respectively, see FIGS. *7a* and *7b*. Each support member 22R, 22L carries a piston rod guide block or housing 23R, 23L, piston-cylinder combination 24R, 24L, and adjustable angle plates 25R, 25L, respectively.

Referring now more particularly to FIGS. 1, *7a* and *7b*, upper clamping feet 12 each includes a pad 26R, 26L, and is coupled to the piston-cylinder combination 24R, 24L and is pneumatically controlled through fluid inlets 34 and fluid outlets 36 to move upper clamping feet 12 from their initial material engagement position as shown in FIG. *7a* to their final material stretched position shown in FIG. *7b*.

The relative initial and final positions of upper clamping feet 12 are adjustable and pre-positionable, and for this purpose, support member 22 includes a base portion 38 through which passes retaining screw 40 to hold piston rod guide block 23 in position. Each upper clamping foot 12 is provided with an extension limiting member in the form of angle plates 25 which is adjustable in the same direction that upper clamping feet 12 move, i.e., the limiting members are movable and adjustable in both directions of arrows 16 as indicated by the double head on the arrows. For this purpose, each of the limiting members is L-shaped with a horizontal arm 42 and a vertical arm 44; each arm 42 has an elongated opening 46 for receiving a locking and adjusting screw 48 which cooperates with washer 50 to lock the arm 42 of limiting member 25 to piston rod guide block 23. For this purpose, piston rod guide block 25 is suitably tapped to receive locking and adjusting screw 48. Movement of extension limiting member 44 in the direction of arrows 16 changes the amount of movement of upper clamping feet in the direction of arrows 16. Adjustment of adjusting or set screws 48 will limit travel of angle plates 25 and cooperates with set screw 48 to determine the size of gap 49 at the end of travel of the clamp foot assemblies.

Locking nut 52 is provided to connect and disconnect upper clamping foot 12 to and from threaded end portion of piston rod 32 which rides within cylinder 30 in housing 23. Of course, other suitable connect and disconnect means may be used.

Figure 2:
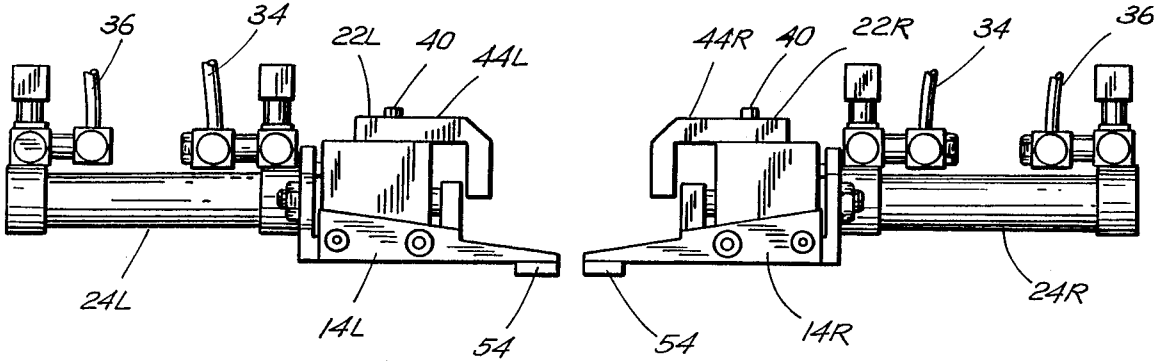
FIG. 2 is a front elevational view looking in the direction of arrow 2 on FIG. 1 and from the bottom thereof, with the material omitted; the feet of the dart stretcher are shown in their actual initial position, partially separated in this position for positioning on opposite sides of the pocket welting and just prior to or upon initial engagement with the material.
Figure 3:
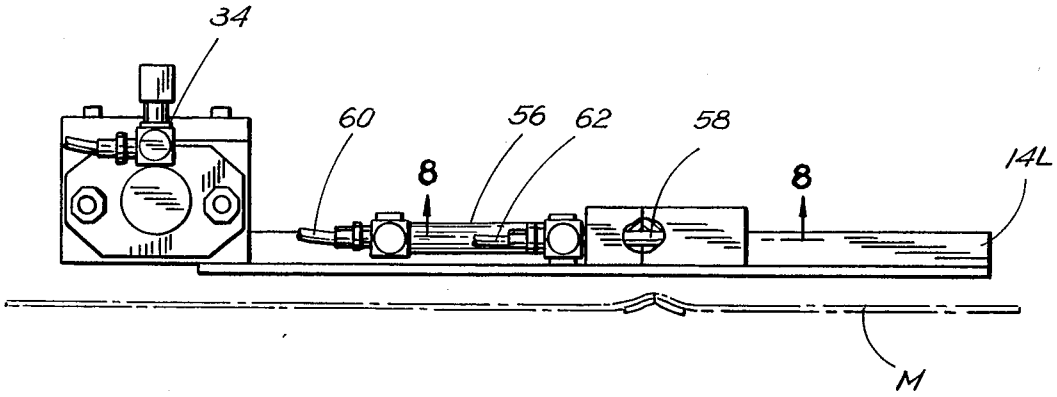
FIG. 3 is a side view looking in the direction of arrow 3 on FIG. 1 and looking at the left side of the dart stretcher as seen in FIG. 1, but with the material shown in an unstretched condition; the dart stretcher is shown in its normal or actual retracted condition and above the material just prior to initial engagement of the dart stretcher with the material and just prior to commencement of stretching.
Figure 4A:
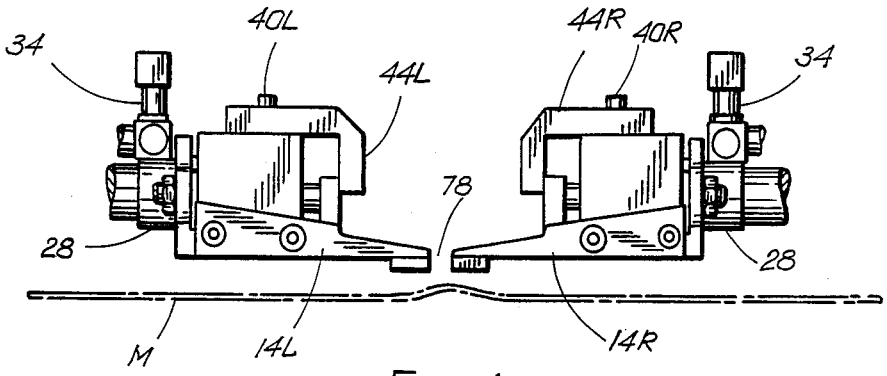
FIG. 4*a* shows the dart stretcher in a first or its initial condition with the left and right feet spaced from each other prior to activation thereof.
Figure 4B:
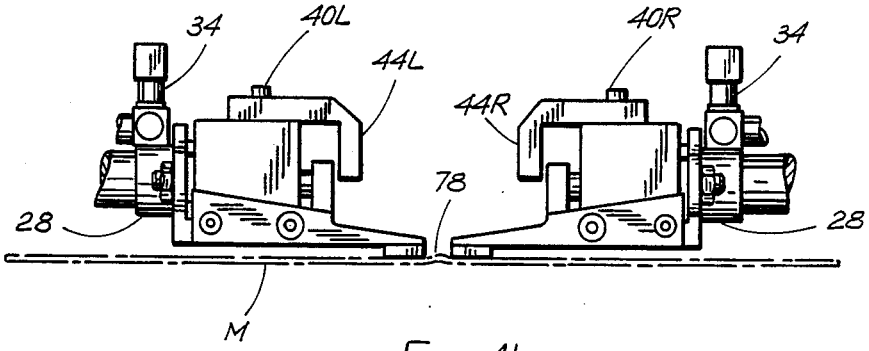
FIG. 4*b* is also a partial front view looking in the direction along line 4—4 of FIG. 1 and shows the dart stretcher in a second or one of its intermediate positions after it has commenced its movement for lowering onto the material to be stretched and in contact with the material.
Figure 4C:
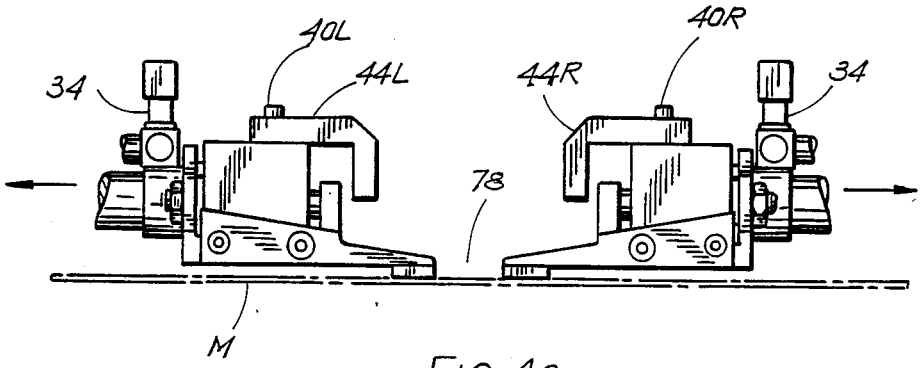
FIG. 4*c* is also a partial front view looking in the direction of line 4—4 of FIG. 1 showing the front feet in a condition moved from the FIGS. 4*a* and 4*b* position, and showing the feet in their final position; the feet are shown in relation to the material after being placed onto and engaged with the material and the material is fully stretched to remove any fullness thereof.
Figure 5A:
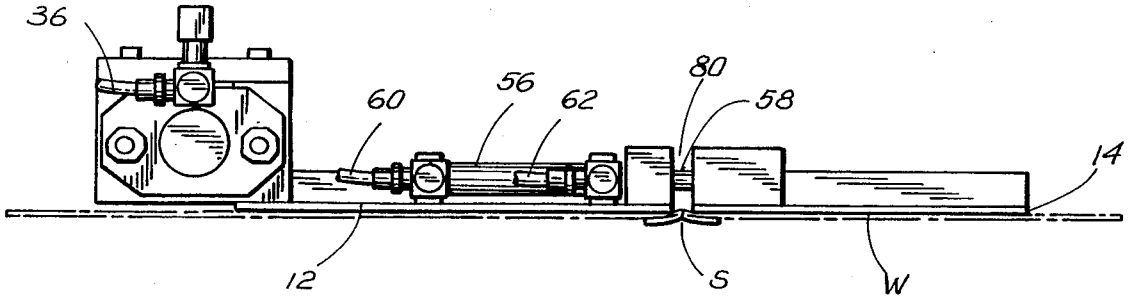
FIG. 5*a* is a right side view looking in the direction of arrow 3 in FIG. 1 at the left side of the dart stretcher as depicted in FIG. 1 with the material in a partially stretched and in an unstretched condition; the material is shown after engagement by the dart stretcher with the material on each side of the dart in an intermediate stretched condition; the dart stretcher is shown in a position of operation after the FIG. 3 position, in an exaggerated manner in its position after the engagement position with the material and after some stretching has taken place.
Figure 5B:
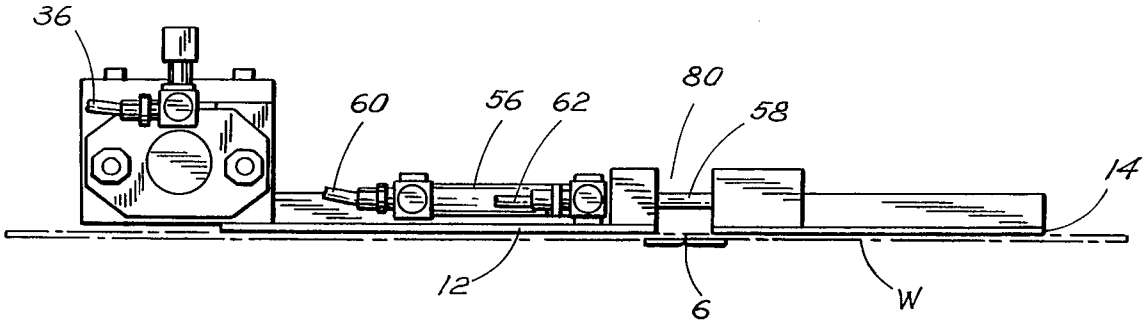
FIG. 5*b* shows the dart stretcher in its final stretched condition, with the fullness of the material on opposite sides of the dart removed.
Figure 7A:
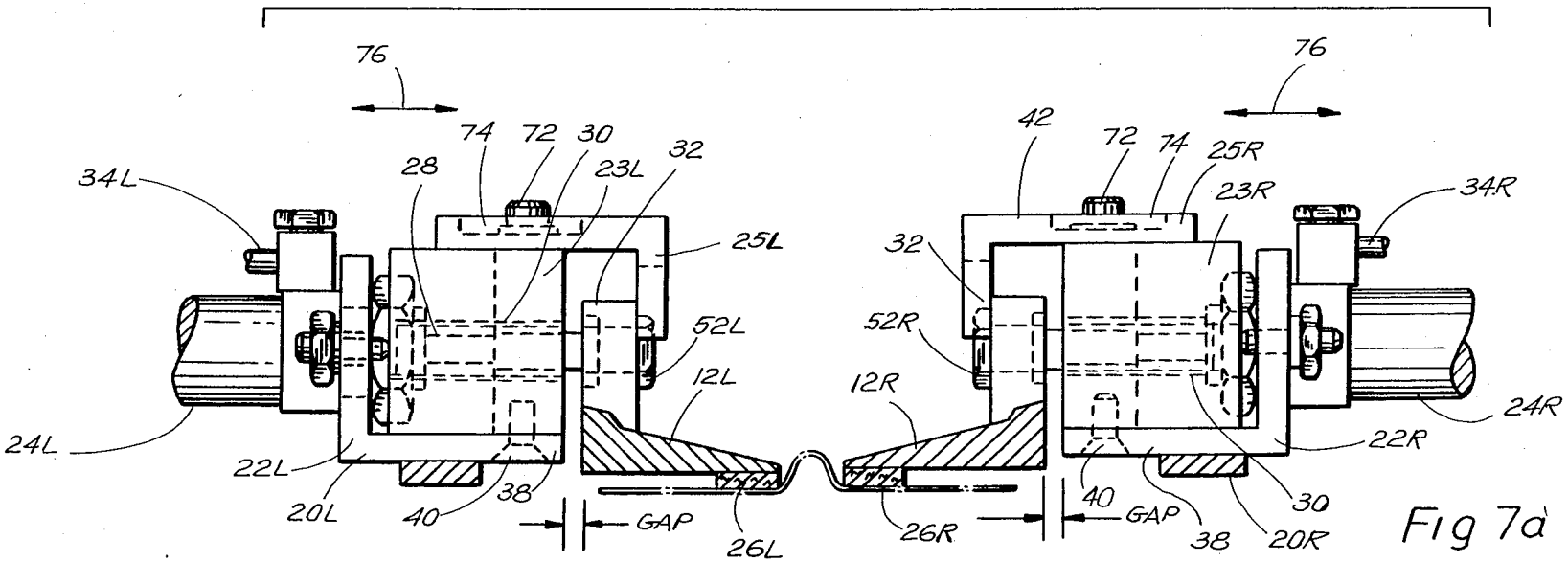
FIGS. 7*a* and 7*b* are each sections of the upper clamping feet taken along line 7—7 of FIG. 1 showing the clamping feet in their initial and final positions.
Figure 7B:
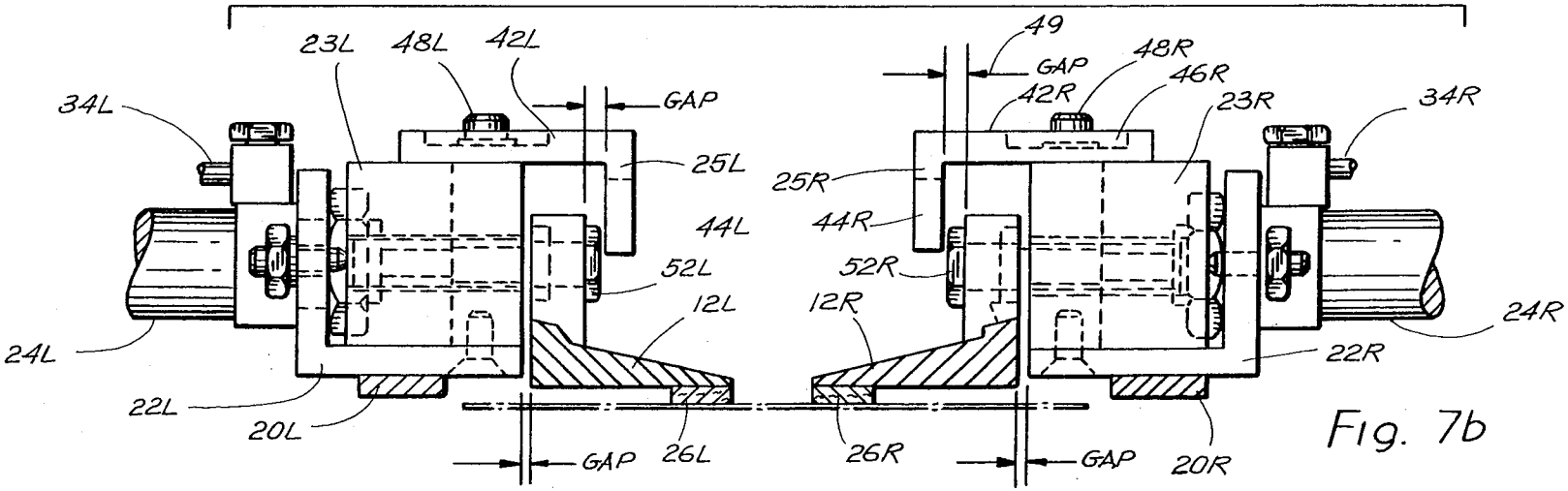
Figure 6A:
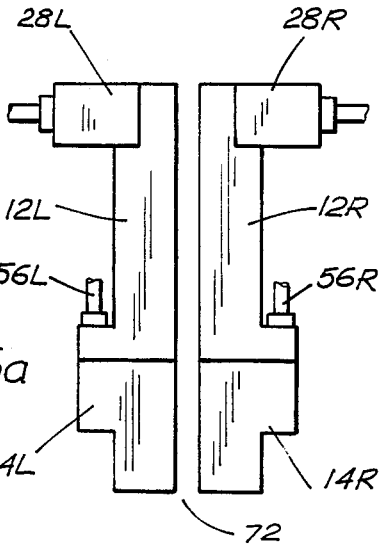
FIGS. 6*a* to 6*c* are schematic showings of three different views of the dart stretcher schematically showing the feet in different positions and in the positions shown in FIGS. 4*a*, 4*b* and 4*c*, respectively, as well as FIGS. 3, 5*a* and 5*b*, respectively; the feet being moved in a first direction and then in a second direction perpendicular to the first direction; the material has been omitted for the sake of clarity.
Figure 6B:
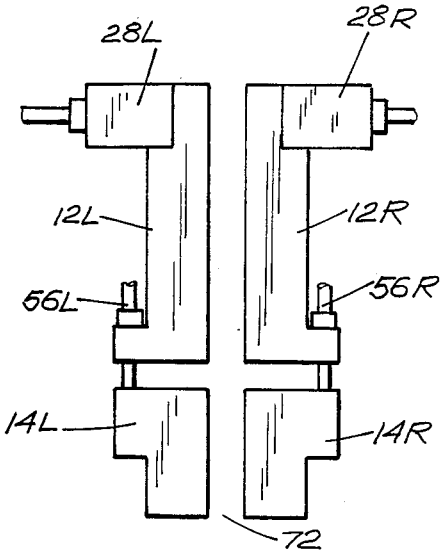
Figure 6C:
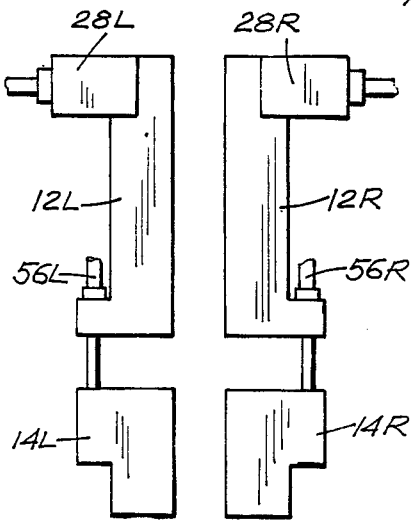
Figure 9A:
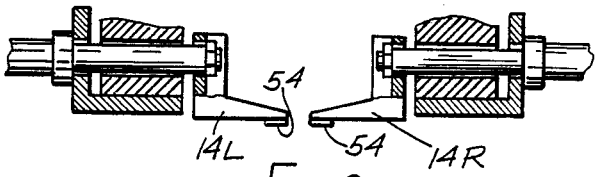
FIGS. 9*a* and 9*b* are partial sectional views of the lower feet looking in the direction of arrow 2 in FIG. 1 with the upper feet omitted.
Figure 9B:
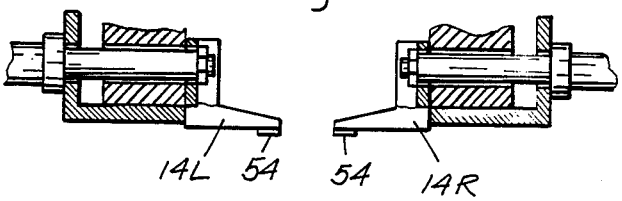
Figure 8A:
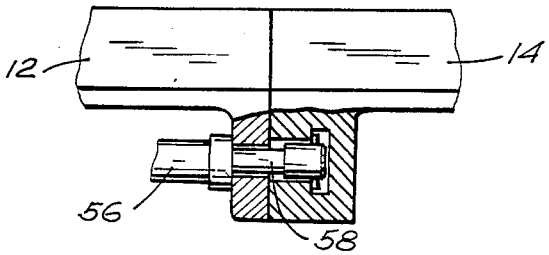
FIGS. 8*a* and 8*b* are partially sectional enlarged side views taken on line 8—8 of FIG. 1 showing one pair of the lower and upper feet in their initial position together and separate positions, respectively.
Figure 8B:
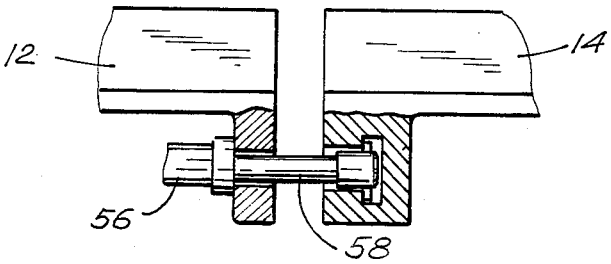

Referring now more particularly to FIGS. 1 to 3, lower clamping feet 14L and 14R are each provided with a pad 54 similar to or equivalent to pad 26. As best seen in FIGS. 1, 3 and 5, piston-cylinder combination 56 couples an upper 12 and a lower clamping foot 14 to each other for movement along double-headed arrow 18 to remove fullness in the material M in their extended condition. Piston-cylinder combination 56 in a manner similar to piston-cylinder combination 28 includes a piston 58 which is movable in response to pneumatic control and includes inlet pneumatic means shown as tube 62 in order to move piston 58 towards the right from its initial position as shown in FIG. 3 to one of its intermediate positions shown in FIG. *5a* to its final position shown in FIG. *5b* for moving lower clamping foot 14 away from upper clamping foot 12 and remove the fullness from material M in the direction of arrows 18 and to flatten the area around dart seam S as much as possible, particularly in the area of the seam S to which the pocket welting will be adjacently placed.

To control the relative spacing between the upper and lower clamping feet, adjusting screw 64 (see FIG. 1) has one end fixed to upper clamping foot 12 and lower clamping foot 14 is provided with a passageway through which the other end 65 of adjusting screw 64 passes for connection with collar 66 to provide for relative limited and controlled movement of lower clamping foot 14 relative to upper clamping foot 12 and a controlled change in the relative spacing between the upper and lower clamping feet in response to separation therebetween imparted by piston 58.

Lower clamping feet 14 also have a pivot block assembly 68 connected with piston 58 and lower clamping foot 14 is held for movement in the direction of arrow 16 together with upper clamping foot 12 as a unit by means of alignment shaft 70 and adjusting screw 64. Movement in one of the directions of arrow 18 of lower clamping foot 14 relative to upper clamping foot 12 is controlled by piston-cylinder combination 56 and limited by a separation distance controlled by the combination of piston 58, adjusting screw 64 and collar 56.

FIGS. *9a* and *9b* show lower clamping foot 14 with pads 54 which may be the same as or equivalent to pads 26.

The clamping feet generally define the points or corners of a four-sided closed polygonal projection and quadriangular enclosed area.

DESCRIPTION OF OPERATION

Referring now more particularly to FIGS. *6a, 6b* and *6c* to explain the operation and relative movement of the clamping feet.

The dart stretcher according to the invention is placed onto material M having a dart seam S and a pocket P with left clamping feet 12L and 14L on one side of the opening for pocket P and right clamping feet 12R and 14R on the other side of the unsewn portion for pocket P, located substantially in the spacing 78 between left and right clamping feet after initial engagement and after final stretching the clamping feet 12R and 14R are separated from each other so that dart seam S is visible.

Right clamping feet 12R, 14R and left clamping feet 12L, 14L are movable as a unit towards and away from each other in the direction of arrows 16. Feet 12R, 14R form a first group and feet 12L, 14L form a second group to remove the fullness in a direction normal to dart seam S and aligned with the area of pocket P juxtaposed to dart seam S, and feet 12R, 12L form a third group and feet 14R, 14L form a fourth group for movement relatively to each other in a direction normal to the movement of groups one and two and to the dart seam S. Movement in the four opposed directions is sufficient to remove the fullness of the material around dart seam S.

Referring now more particularly to FIGS. *6a, 6b* and *6c*, FIG. *6a* shows all four clamping feet in their initial position just prior to engagement with the material M and the position taken when all four clamping feet are first engaged with the material quadrilaterally arranged about the dart seam S. In FIG. *6a*, feet, 12L and 14L are next to each other in abutment with each other and feet 12R and 14R are also in abutment with each other. However, it is preferred that the feet 12L, 14L as a unit be spaced from feet 12R, 14L as a unit to be spaced from the periphery of pocket P. FIG. *6b*, shows the upper and lower left clamping feet moved apart as a unit in the tranerverse direction and, in the longitudinal direction, the upper feet are now spaced from the lower feet and spaced further from the upper and lower right clamping feet than that shown in FIG. *6a* to increase spacing 78. It should be noted that feet 12L and 14L are moved as a unit and feet 12R and 14R are moved together as a unit. Movement together takes place in both directions laterally, as shown by arrows 16. Also, feet 12L, 12R are moved or spaced from feet 14L, 14R to leave a space 80.

For certain purposes if desired, one set of clamping feet may be held stationary, and the other set may be moved towards or away from the one set in the lateral direction. Activation of piston-cylinder combination ation 24 results in imparting movement to each set of clamping feet. In FIG. *6c*, there is shown a further separation of the lower clamping feet 14L, 14R from the upper clamping feet 12L, 12R, respectively. One movement is made of 12L, 14L as unit and/or 12R, 14R as unit, then lower clamping feet 14L, 14R are moved as a unit by piston-cylinder combination 56L, 56R, respectively.

The lower clamping feet as shown are movable longitudinally in either direction as shown by the double headed arrows 18. It is also within the scope of the invention to have each lower clamping foot moved individually or together. The upper clamping feet can be movable in the longitudinal direction.

While there is shown what is considered to be the preferred embodiments of the invention, various changes and modifications may be made therein without departing from the scope of the invention.

What is claimed is:

1. An automatic dart stretcher for removal of the fullness of material around a dart seam to faciliate the sewing of a pocket welting proximate thereto, comprising:

a pair of spaced connecting arms;

a first pair of clamping feet, one of said clamping feet being operatively associated with each of said connecting arms;

a second pair of clamping feet operatively associated with said first pair of spaced connecting arms and said first pair of feet; and means coupling each of said first and second pair of clamping feet movement together in a first direction and the movement of one each said first and said second of feet for movement in a second direction orthogonal to said first direction.

2. The dart stretcher of claim 1, including:

first pneumatic means associated with said first pair of clamping feet for movement thereof towards and away from each other in a first direction, said first pneumatic means also moving said second pair of clamping feet in the same direction as said first pair of clamping feet; and second pneumatic means for movement of said second pair of clamping feet towards and away from said first pair of clamping feet.

3. The dart stretcher of claim 1, including:

means associated with each of said first and second pair of clamping feet to control the spacing therebetween in their first direction of movement from a starting position prior to commencement of movement thereof to a finishing position after movement thereof.

4. The dart stretcher of claim 1, including:

means associated with each of said first and second clamping feet for selectively moving each of said second clamping feet in the second direction relative to each of said first clamping feet.

5. The dart stretcher of claim 1, wherein:

said first pair of clamping feet includes first and second spaced upper clamping feet positioned on opposite sides of an axial position of the dart stretcher;

said second pair of clamping feet includes first and second spaced lower clamping feet, said first lower clamping foot being coupled to said first upper clamping foot, and said second lower clamping foot being coupled with said second upper clamping foot; and including:

pneumatic means associated with each of said lower clamping feet for movement thereof individually in said second direction;

said first lower clamping foot being movable in two orthogonal directions relative to said second upper clamping foot.

6. The dart stretcher of claim 5, wherein said pneumatic means includes individual means for said second lower clamping foot for movement thereof in two directions relative to said first upper clamping foot.

7. The dart stretcher of claim 2, including:

means associated with each of said first and second pair of clamping feet to control the spacing therebetween in their first direction of movement from a starting position prior to commencement of movement thereof to a finishing position after movement thereof.

8. The dart stretcher of claim 7, including:

means associated with each of said first and second clamping feet for selectively moving each of said second clamping feet in the second direction relative to each of said first clamping feet.

9. An automatic dart stretcher for removing fullness from material proximate to an opening having a dart adjacent to the opening to which a pocket welting is to be seamed, comprising:

a pair of spaced connecting arms for positioning onto a material containing the opening to be seamed;

first and second upper clamping feet, one of said upper clamping feet being associated with each of said spaced connecting arms;

pneumatic means for each said upper clamping feet for movement thereof in a first pathway towards and away from each other;

first and second lower clamping feet, said first lower and upper clamping feet being connected together for movement along said first pathway by said pneumatic means and said second lower and upper clamping feet being connected together for movement along said first pathway by said pneumatic means in a direction towards and away from said first lower and upper clamping feet; and additional pneumatic means operatively associated with said lower clamping feet for movement of said lower clamping feet in a second pathway normal to said first pathway towards and away from said upper clamping feet.

10. The dart stretcher of claim 9, wherein said additional pneumatic means includes individual pneumatic means for each said lower clamping feet for movement thereof in two directions relative to said upper clamping feet.

11. A method for automatically eliminating fullness in a garment material located at the end of a dart, comprising:

feeding the garment material to a dart stretcher associated with a sewing machine or sewing the dart;

gripping the material at four spaced points about the edges of the dart formed or cut into the material to be sewn to form the dart and moving the gripped material in orthogonally related directions by the four spaced gripping points to remove the fullness in the material about the dart.

12. The method of claim 11, including gripping the material at four orthogonally related positions.

13. The method of claim 11, including:

gripping the material at four orthogonal points quadrilaterally arranged about the dart;

imparting a separation movement in a first direction between one set of two gripping points and a second set of the remaining two gripping points; and imparting another separation movement in an orthogonal direction between another grouping of the four points into another two different sets.

14. The method of claim 11, including:

gripping the material at four orthogonally related points, a first and second of the gripping points being on one side of the seam to be sewn, and a third and fourth of the gripping points being on the other side of the seam to be sewn, the first and third points being positioned proximate to the dart seam and adjacent to one side of the seam to be sewn and the second and fourth points being positioned proximate to the other side of the seam to be sewn;

moving a first group composed of the first and second gripping points and a second group composed of the third and fourth sets of gripping points away from each other in a first direction normal to said first and second groups of points; and moving a third group composed of the first and third gripping points and a fourth group composed of the second and fourth gripping points away from each other in a second direction normal to said third and fourth groups and orthogonal to said first direction.

15. The method of claim 11, including moving of the material at one set of spaced gripping points in a direction away from another set of spaced gripping points, and then moving one gripping point in each of said one set and said other set of spaced gripping points in a second direction away from the remaining gripping points of said one and said other set of spaced gripping points.

16. The method of claim 11, including providing for clamping feet for gripping the material, two of said clamping feet forming a first set having an upper and a lower clamping foot, and moving the upper and lower clamping feet of each said first and said second set as a unit and moving the lower clamping feet away from the upper clamping feet to remove the fullness in the material.

17. The method of claim 11, including:

initially gripping the material and imparting a preliminary stretch to the material; and imparting a further stretch to the material at the four orthogonally spaced points to remove the fullness from the material within the confines of the four spaced points.

* * * * *